US007517033B2

(12) United States Patent
Tanaka et al.

(10) Patent No.: US 7,517,033 B2
(45) Date of Patent: Apr. 14, 2009

(54) INK SUPPLY CONTROL APPARATUS, INK JET PRINTER AND METHOD OF CONTROLLING INK SUPPLY

(75) Inventors: Takayuki Tanaka, Matsumoto (JP); Yoshiaki Shibasaki, Suwon (JP)

(73) Assignee: Seiko Epson Corporation, Tokyo (JP)

( * ) Notice: Subject to any disclaimer, the term of this patent is extended or adjusted under 35 U.S.C. 154(b) by 254 days.

(21) Appl. No.: 11/698,471

(22) Filed: Jan. 25, 2007

(65) Prior Publication Data

US 2007/0171250 A1 Jul. 26, 2007

(30) Foreign Application Priority Data

Jan. 26, 2006 (JP) ..... 2006-017378

(51) Int. Cl.
*B41J 29/38* (2006.01)
*B41J 2/175* (2006.01)

(52) U.S. Cl. ..... 347/6; 347/85

(58) Field of Classification Search ..... 347/6, 347/85

See application file for complete search history.

(56) References Cited

U.S. PATENT DOCUMENTS 6,079,808 A * 6/2000 Yamaguchi ..... 347/7

FOREIGN PATENT DOCUMENTS

JP 2005-271588 10/2005

* cited by examiner

*Primary Examiner*—Julian D Huffman
(74) *Attorney, Agent, or Firm*—Edwards Angell Palmer & Dodge LLP; John J. Penny, Jr.

(57) ABSTRACT

An ink supply control apparatus includes: a driver, operable to drive a selector provided between a recording head and an ink tank to control an ink supply from the ink tank to the recording head; a detector, operable to detect that the selector is disposed in a predetermined position between two positions of at least two control positions; and a controller, operable to control the driver so as to stop the selector in one of the two positions in a predetermined time after the detector detects that the selector is disposed in the predetermined position.

12 Claims, 9 Drawing Sheets

POSITION CORRECTING SEQUENCE AT STARTING

DRIVING SEQUENCE INTO PHOTO RANGE

DRIVING SEQUENCE TO PHOTO END POSITION

INK SUPPLY CONTROL APPARATUS, INK JET PRINTER AND METHOD OF CONTROLLING INK SUPPLY

BACKGROUND

1. Technical Field

The present invention relates to an ink supply control apparatus, an ink jet printer and a method of controlling an ink supply.

2. Related Art

JP-A-2005-271588 is disclosed a printer (for example, refer to Paragraphs 0023 and 0024, FIG. 1). An ink to be a liquid having a color corresponding to each nozzle is supplied through each tube from an ink cartridge provided on a frame to a recoding head provided on a lower surface of a carriage of the printer. Each ink flowing into the recording head is pressurized by a piezoelectric element which is not shown and is ejected as an ink droplet from the nozzle of the recording head.

In the case in which the ink is supplied from the ink cartridge provided separately from the carriage to the recording head through the tube as in the printer according to the JP-A-2005-271588, furthermore, it is necessary to provide an ink selector for switching an ink to be a supply source into an ink supply path from the ink cartridge to the recording head when the ink to be supplied to the recording head is switched from the other one.

By providing the ink selector on an ink cartridge separated from the carriage, it is possible to suppress an increase in a size and weight of the carriage. By suppressing the increase in the size and weight of the carriage, there are advantages that it is possible to apply other design assets for a driving system of the carriage and to lessen a design change around the carriage.

In the case in which the ink to be the supply source is thus switched on the ink cartridge, however, it is necessary to replace all of the inks in the tube from the ink selector provided on the ink cartridge to the recording head when changing over the ink. As a result, a large amount of inks are not utilized for printing but are wasted. In addition, it is necessary to take a long time for replacing the ink.

Therefore, it has been desired to provide the ink selector in the carriage while suppressing the increase in the size and weight of the carriage. Even if the size and weight of the ink selector itself is simply reduced, however, it is impossible to effectively suppress the increase in the size and weight of the carriage. In the case in which the ink selector is provided in the carriage, it is desired to provide, in the carriage, a member to be used together with the ink selector, for example, a detecting unit for detecting a control position of the ink selector and a driving motor for switching the control position of the ink selector.

In particular, the number of the detecting unit for detecting the control position of the ink selector is increased when the number of the control positions of the ink selector is increased. It a detecting unit based on a mechanical contact is provided every control position of the ink selector or an encoder for detecting a plurality of control positions of the ink selector is provided, it is hard to suppress the increase in the size and weight of the carriage.

SUMMARY

An advantage of some aspects of the invention is to provide an ink supply control apparatus capable of carrying out a control over each of a plurality of control positions for an ink supply control while detecting a smaller number of positions than the control positions, an ink jet printer and a method of controlling an ink supply.

According to an aspect of the invention, there is provided an ink supply control apparatus comprising:

a driver, operable to drive a selector provided between a recording head and an ink tank to control an ink supply from the ink tank to the recording head;

a detector, operable to detect that the selector is disposed in a predetermined position between two positions of at least two control positions; and a controller, operable to control the driver so as to stop the selector in one of the two positions in a predetermined time after the detector detects that the selector is disposed in the predetermined position.

The present disclosure relates to the subject matter contained in Japanese patent application No. 2006-017378 filed on Jan. 26, 2006, which is expressly incorporated herein by reference in its entirety.

BRIEF DESCRIPTION OF THE DRAWINGS

The invention will be described with reference to the accompanying drawings, wherein like numbers reference like elements.

DESCRIPTION OF EXEMPLARY EMBODIMENTS

An ink supply control apparatus, an ink jet printer and a method of controlling an ink supply according to an embodiment of the invention will be described below with reference to the drawings. The ink supply control apparatus will be described as a part of the ink jet printer. The method of controlling the ink supply will be described as a part of an operation of the ink jet printer.

Figure 1:
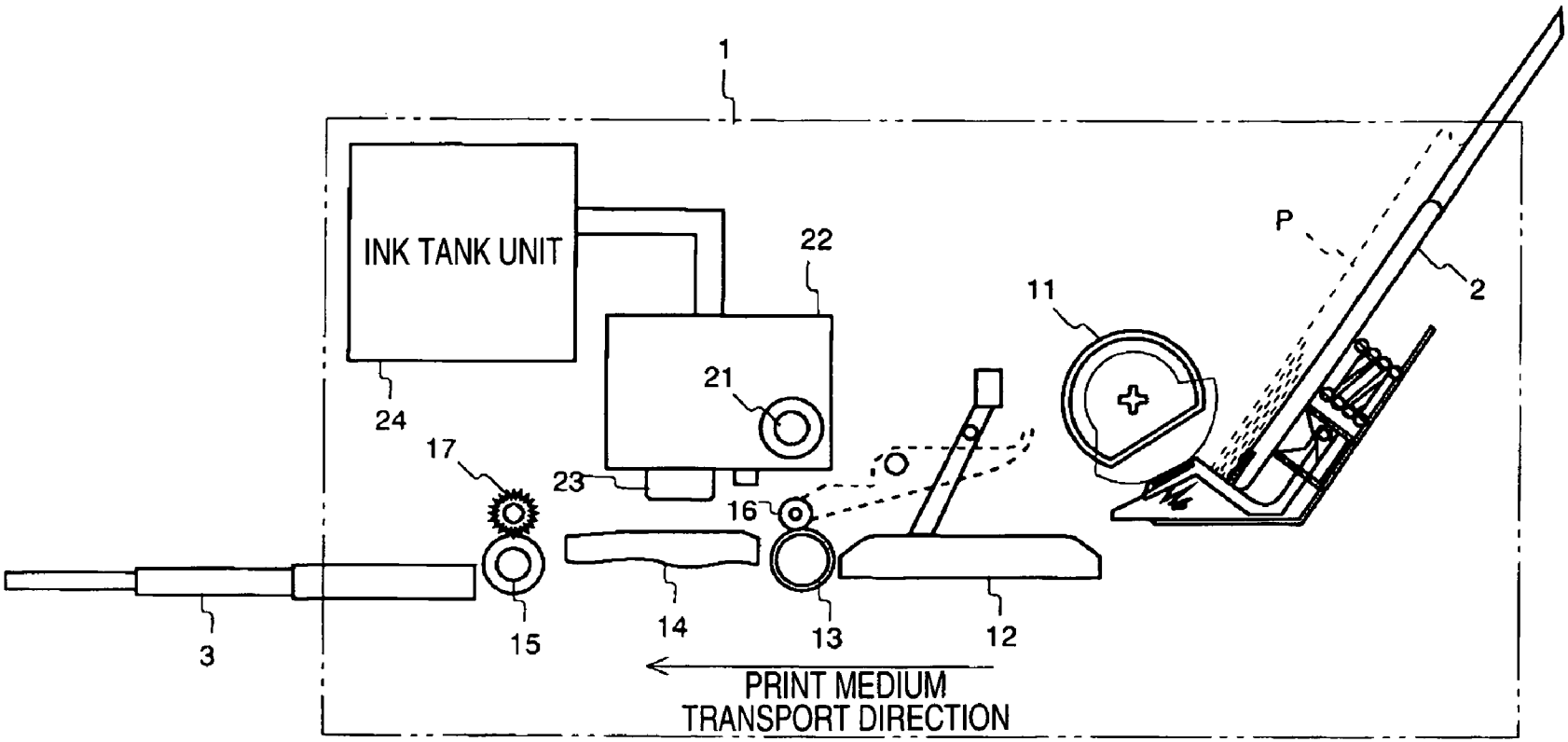
FIG. 1 is a schematic view showing a structure of an ink jet printer according to an embodiment of the invention.

FIG. 1 is a schematic view showing a structure of an ink jet printer 1 according to the embodiment of the invention. The ink jet printer 1 is configured to transport a print medium P such as a paper mounted on a paper feed tray 2 to a paper discharge tray 3 and to eject an ink to the print medium P in the middle of a transport path for the print medium P, thereby carrying out printing. In the ink jet printer 1, particularly, a plurality of ink tanks 25 (see FIG. 2) is removably attached to an ink tank unit 24 provided separately from a carriage 22.

The ink jet printer 1 includes an LD (load) roller 11, a paper guide 12, a PF (paper feed) roller 13, a platen 14, and a paper discharge roller 15 as a mechanism for transporting the print medium P.

The LD roller 11 has an almost D-shaped sectional shape obtained by cutting a part of a cylinder away. The LD roller 11 is provided apart from the paper feed tray 2 at a distance which is almost equivalent to a radius of the cylinder. The LD roller 11 is disposed rotatably in a direction of an outer periphery of the cylinder. The LD roller 11 is disposed away from the paper feed tray 2 with a notch portion opposed to the paper feed tray 2 while a paper feeding operation is not carried out. The print medium P is mounted on the paper feed tray 2 in a state in which it enters between the notch portion and the paper feed tray 2.

The paper guide 12, the PF roller 13, the platen 14 and the paper discharge roller 15 are arranged in a line in this order between the paper feed tray 2 and the paper discharge tray 3 as shown in FIG. 1.

The PF roller 13 and the paper discharge roller 15 have almost cylindrical shapes. The PF roller 13 and the paper discharge roller 15 are disposed rotatably in a direction set along a direction of transport of the print medium P, respectively. Respective follower rollers 16 and 17 are disposed on upper sides of the PF roller 13 and the paper discharge roller 15. The follower roller 16 and the follower roller 17 abut on the PF roller 13 and the paper discharge roller 15, respectively.

The LD roller 11, the PF roller 13 and the paper discharge roller 15 are rotated and driven by means of a PF motor which is not shown. When the LD roller 11 is rotated, the print medium P mounted on the paper feed tray 2 is fed from the paper feed tray 2 and is supplied to the transport path for the print medium P. The print medium P supplied to the transport path by means of the LD roller 11 is interposed between the PF roller 13 and the follower roller 16. When the PF roller 13 is rotated, the print medium P is transported to the paper discharge tray 3 side. The print medium P transported toward a downstream side over the transport path by means of the PF roller 13 is interposed between the paper discharge roller 15 and the follower roller 17. When the paper discharge roller 15 is rotated, the print medium P is discharged to the paper discharge tray 3.

Moreover, the ink jet printer 1 includes a carriage shaft 21, the carriage 22, a recording head 23 and the ink tank unit 24 as a mechanism for ejecting an ink to the print medium P.

The carriage shaft 21 is disposed in almost parallel with the PF roller 13 above the PF roller 13. The carriage shaft 21 holds the carriage 22 movably in an axial direction (a main scanning direction) of the carriage shaft 21. The carriage 22 is driven in the axial direction of the carriage shaft 21 by means of a CR (carriage) motor which is not shown. The recording head 23 is disposed on a lower surface of the carriage 22 so as to be opposed to the platen 14. The recording head 23 includes a plurality of nozzles which is not shown. A piezoelectric element which is not shown is disposed in the nozzles.

Figure 2:
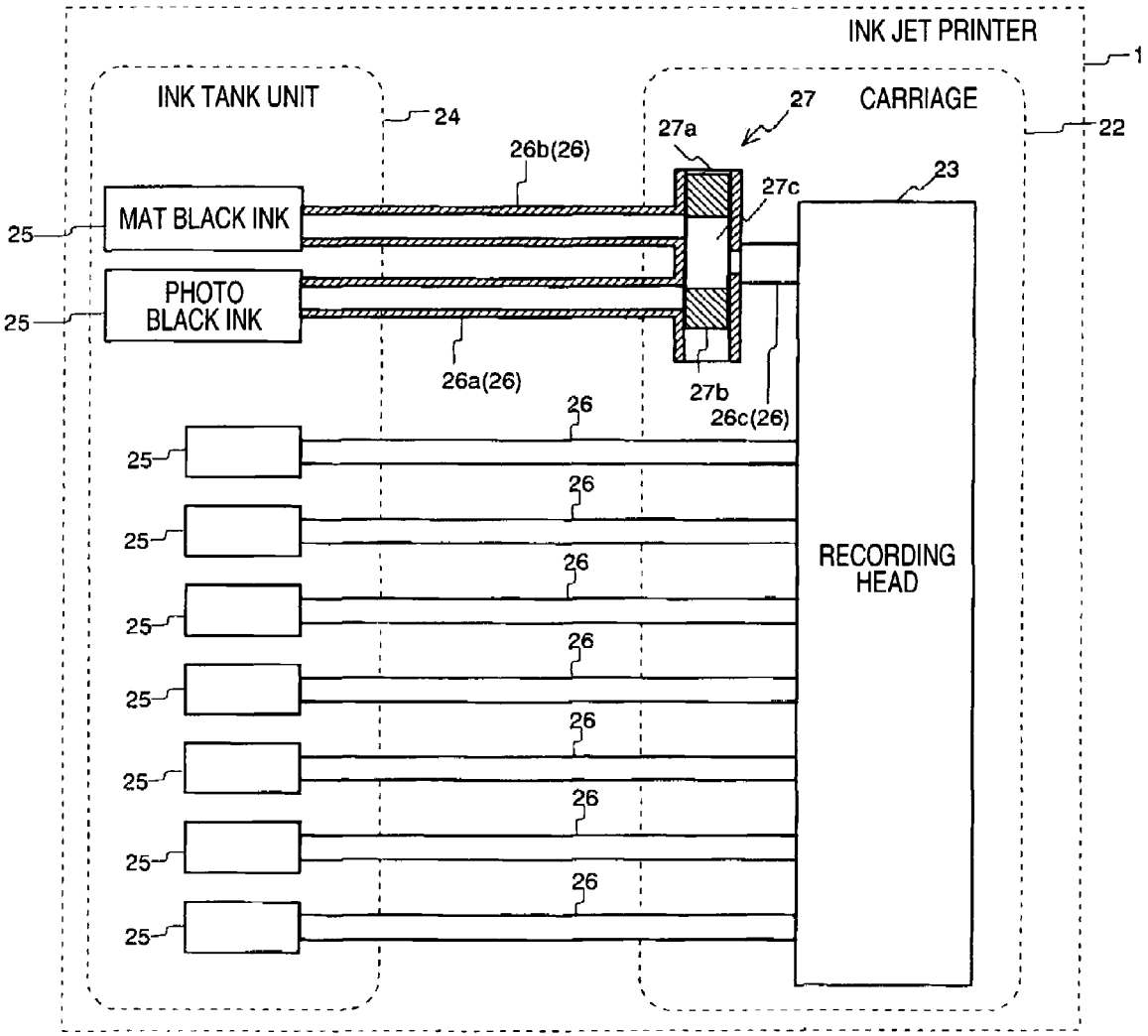
FIG. 2 is a view showing a structure of an ink supply mechanism of the ink jet printer in FIG. 1.

FIG. 2 is a view showing a structure of an ink supply mechanism of the ink jet printer 1 in FIG. 1. The ink tank unit 24 is disposed above the paper discharge tray 3 of the ink jet printer 1 as shown in FIG. 1. The ink jet printer 1 includes a door cover which is not shown. When the door cover is opened, the ink tank unit 24 is exposed. The ink tank unit 24 is provided in a fixing portion which is a body side of the ink jet printer 1.

Each of the nine ink tanks 25 is disposed removably in the ink tank unit 24. The nine ink tanks 25 accommodate one of colors of a photo black ink, a mat black ink, a normal black ink, a cyan ink, a magenta ink, a yellow ink, a red ink, a blue ink, and a gloss optimizer ink. The gloss optimizer ink is colorless. Inks having a plurality of colors may be accommodated in one ink tank 25. By opening the door cover, it is possible to exchange the ink tank 25.

A plurality of tubes 26 is connected to the ink tank unit 24. It is preferable that the number of the tubes 26 should be equal to that of the colors of the inks to be supplied from the ink tank unit 24. In the embodiment, the number of the tubes 26 is nine. Each of the tubes 26 is connected to each of the ink tanks 25 in the ink tank unit 24.

The tube 26 to be connected to the ink tank 25 accommodating the photo black ink (which will be hereinafter referred to as a photo black tube 26*a*) and the tube 26 to be connected to the ink tank 25 accommodating the mat black ink (which will be hereinafter referred to as a mat black tube 26*b*) are connected to an ink selector 27. The ink selector 27 is connected to the recording head 23 by means of the tube 26 (which will be hereinafter referred to as a supply tube 26*c*). The tubes 26 connected to the ink tanks 25 accommodating the inks having the other colors are directly connected to the recording head 23.

The ink selector 27 is provided in the carriage 22 together with a DC motor 34 which will be described below. Consequently, a length of the supply tube 26*c* for connecting the ink selector 27 to the recording head 23 can be set to be a minimum. If the ink selector 27 is provided in the ink tank unit 24 disposed separately from the carriage 22, the length of the supply tube 26*c* is increased. In the ink jet printer 1, however, the length of the supply tube 26*c* is reduced.

When the ink to be supplied to the recording head 23 is to be switched between the photo black ink and the mat black ink, it is necessary to replace the whole ink in the supply tube 26*c* from the ink selector 27 to the recording head 23. By setting the supply tube 26*c* to have a minimum length, it is possible to minimize the amount of the ink in the replacement which is consumed wastefully with out contributing to the printing. For the replacement of the ink, moreover, the ink is sucked from the recording head 23 side by using a sucking pump. A time required for replacing the ink in the supply tube 26*c* can also be set to be a minimum.

The ink selector 27 includes a selector housing 27*a*. The selector housing 27*a* has a substantial cylindrical shape. The supply tube 26*c*, the mat black tube 26*b* and the photo black tube 26*a* are connected to the selector housing 27*a* so as to communicate with an inner part of the cylinder. The supply tube 26*c* is connected to an almost central part in an axial direction of the cylinder of the selector housing 27*a*. The mat black tube 26*b* and the photo black tube 26*a* are connected to the selector housing 27*a* in order to interpose a connecting position of the supply tube 26*c* therebetween.

The selector housing 27*a* is formed with a cylinder 27*b* therein. The cylinder 27*b* has a cylindrical shape having a radius which is substantially equal to or slightly smaller than an inside diameter of the selector housing 27*a*. Consequently, an internal space of the cylinder 27*b* is closed except for a slight space. The cylinder 27*b* has a slot 27*c*. The slot 27*c* is formed in an almost central part in an axial direction of the cylinder 27*b*. The slot 27*c* is formed to penetrate through an outer peripheral surface in a substantial perpendicular direction to an axis of the cylinder 27*b* (a vertical direction in FIG. 2).

Figure 3:
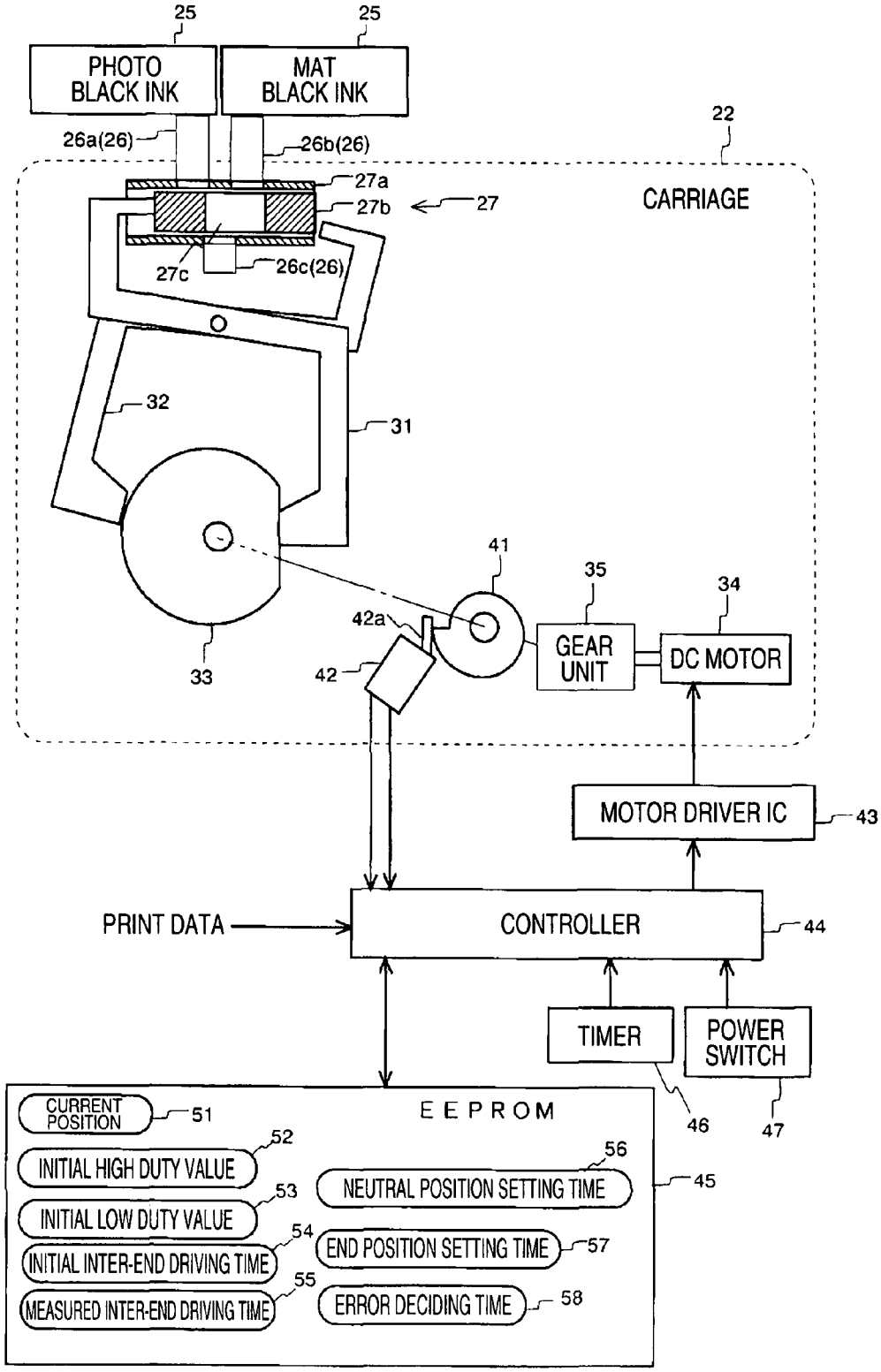
FIG. 3 is a block diagram showing a control system for driving an ink selector in FIG. 2.

FIG. 3 is a block diagram showing a control system for driving the ink selector 27 in FIG. 2. The ink jet printer 1 includes a pair of push arms 31 and 32, a rotator 33, the DC (direct current) motor 34 for driving the rotator 33, and a gear unit 35 for transmitting a rotating and driving force of the DC motor 34 to the rotator 33. The pair of push arms 31 and 32, the rotator 33, the DC motor 34 and the gear unit 35 are provided in the carriage 22 together with the ink selector 27.

The push arms 31 and 32 have an almost S shape, respectively. The push arm 31 is disposed in a direction of the S shape in FIG. 3, and the push arm 32 is disposed in a direction in which a surface and a back of the S shape are inverted. The push arms 31 and 32 are fixed rotatably in middle parts thereof in such a manner that the center of the S shape is a rotating center. The push arms 31 and 32 are overlapped with each other as shown in FIG. 3. Consequently, the push arms 31 and 32 can interpose a thing therebetween in both end portions. The push arms 31 and 32 are operated in such a manner that tip portions at one end are closed when the other tip portions are closed.

The push arms 31 and 32 are disposed in such a manner that the tip portions can be inserted into an inner part of the selector housing 27*a* from both ends of the selector housing 27*a* as shown in FIG. 3. Moreover, the push arms 31 and 32 interpose the rotator 33 between the other tip portions. The rotator 33 has an almost D shape obtained by taking a part of a disk away.

Figure 4:
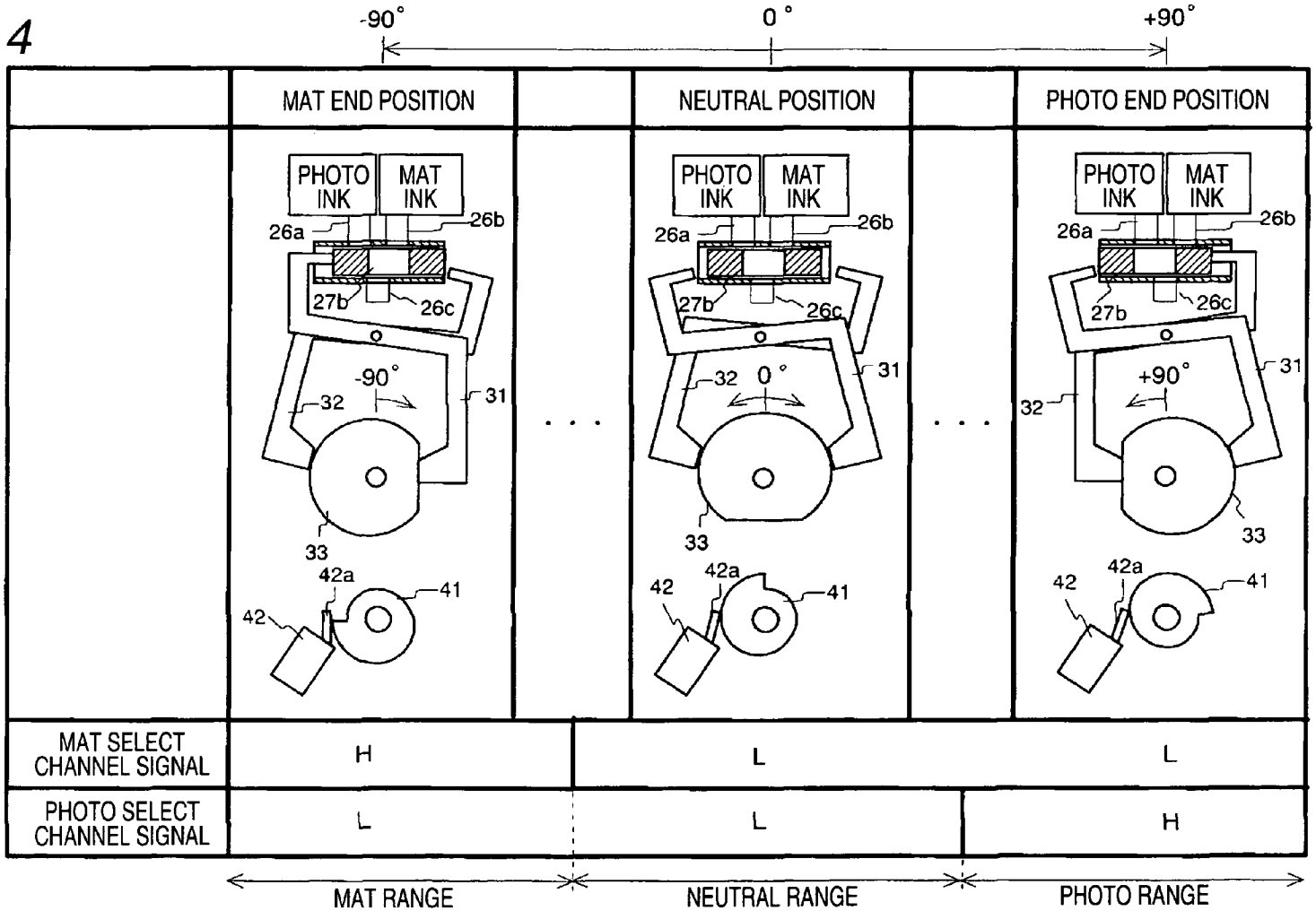
FIG. 4 is a correlation diagram showing a cylinder, a pair of push arms and a rotator in FIG. 3.

FIG. 4 is an explanatory diagram showing a correlation between a control position of the cylinder 27*b* in FIG. 3 and positions of the push arms 31 and 32 and the rotator 33 corresponding thereto. A target control position of the cylinder 27*b* (the rotator 33) includes a mat end position shown on a left side of FIG. 4, a neutral position shown in a center of FIG. 4 and a photo end position shown on a right side of FIG. 4.

In the neutral position, the rotator 33 takes a posture in which a notch portion is turned downward. The push arms 31 and 32 interpose an outer peripheral portion having a circular shape of the rotator 33. As a result, the push arms 31 and 32 are separated from the selector housing 27*a*. The cylinder 27*b* can be freely moved in the selector housing 27*a*. Therefore, the cylinder 27*b* can be positioned in an almost central part in the selector housing 27*a*. The photo black tube 26*a* and the mat black tube 26*b* communicate with the supply tuber 26*c* through the slot 27*c* of the cylinder 27*b*.

In the mat end position, the rotator 33 has the notch portion placed on a right side of FIG. 4. The push arms 31 and 32 interpose the rotator 33 therebetween, and the push arm 31 in FIG. 4 abuts on the notch portion of the rotator 33. As a result, the push arm 31 in FIG. 4 is inserted into the inner part of the selector housing 27*a* from a left side of the selector housing 27*a*. For this reason, the push arm 31 pushes the cylinder 27*b* in a rightward direction in FIG. 4. The cylinder 27*b* is positioned a little to a right side in FIG. 4 in the selector housing 27*a*. Only the mat black tube 26*b* communicates with the supply tube 26*c* through the slot 27*c* of the cylinder 27*b*. The photo black tube 26*a* does not communicate with the supply tube 26*c*.

In the photo end position, the rotator 33 includes the notch portion placed on a left end of FIG. 4. The push arms 31 and 32 interpose the rotator 33 therebetween, and the push arm 32 in FIG. 4 abuts on the notch portion of the rotator 33. As a result, the push arm 32 in FIG. 4 is inserted into the inner part of the selector housing 27*a* from a right side of the selector housing 27*a*. For this reason, the push arm 32 pushes the cylinder 27*b* in a leftward direction in FIG. 4. The cylinder 27*b* is positioned a little to a left side in FIG. 4 in the selector housing 27*a*. Only the photo black tube 26*a* communicates with the supply tube 26*c* through the slot 27*c* of the cylinder 27*b*. The mat black tube 26*b* does not communicate with the supply tube 26*c*.

Referring to a rotating angle of the rotator 33 in the following description, the rotating angle of the rotator 33 in the mat end position is set to be −90 degrees, the rotating angle of the rotator 33 in the neutral position is set to be zero degree, and the rotating angle of the rotator 33 in the photo end position is set to be +90 degrees.

As shown in FIG. 3, the control system for driving the ink selector 27 further includes a cam member 41, a two-contact lever detecting switch 42, a motor driver IC (Integrated Circuit) 43, a controller 44, an EEPROM (Electrically Erasable Programmable ROM) 45, a timer 46 for measuring a time, and a power switch 47.

The cam member 41 has a shape of an almost disk which has a radius increased stepwise and looks like a spiral shell. The cam member 41 is formed integrally with the rotator 33 in a positional relationship in which a maximum radius portion of the cam member 41 is shifted from the notch portion of the rotator 33 by 180 degrees. The cam member 41 is rotated together with the rotator 33 by a rotating and driving operation of the DC motor 34.

The two-contact lever detecting switch 42 includes a rockable lever 42*a* and three terminals which are not shown. The three terminals are arranged in a line. Two terminals on both ends are connected to a middle terminal in accordance with a rocking position of the lever 42*a*. The two-contact lever detecting switch 42 outputs an MSC (mat select channel) signal and a PSC (photo select channel) signal shown in FIG. 4 from the two terminals on both ends. The MSC signal and the PSC signal are supplied to the controller 44.

In the two-contact lever detecting switch 42, moreover, a tip portion of the lever 42*a* abuts on an outer peripheral surface of the cam member 41 as shown in FIGS. 3 and 4. As shown in FIG. 4, the lever 42*a* abuts on a maximum radius portion of the cam member 41 in the mat end position. At this time, the two-contact lever detecting switch 42 to be operated normally outputs an MSC signal having a high level and a PSC signal having a low level. In the neutral position, the lever 42*a* abuts on a portion turned by 90 degrees from the maximum radius portion of the cam member 41. At this time, the two-contact lever detecting switch 42 outputs an MSC signal having the low level and the PSC signal having the low level. In the photo end position, the lever 42*a* abuts on a portion turned by 180 degrees from the maximum radius portion of the cam member 41. At this time, the two-contact lever detecting switch 42 outputs the MSC signal having the low level and a PSC signal having the high level.

Thus, the MSC signal is set to have the high level in the mat end position and is set to have the low level in the neutral position and the photo end position. The MSC signal is switched between the high level and the low level in a predetermined position between the mat end position and the neutral position, for example, a position of approximately −20 degrees.

Moreover, the PSC signal is set to have the high level in the photo end position and is set to have the low level in the neutral position and the mat end position. The PSC signal is switched between the high level and the low level in a predetermined position between the photo end position and the neutral position, for example, a position of approximately +20 degrees.

A rotating angle range in which the MSC signal is set to have the high level will be referred to as a mat range, a rotating angle range in which the PSC signal is set to have the high level will be referred to as a photo range, and a range therebetween in which both the MSC signal and the PSC signal are set to have the low level will be referred to as a neutral range.

The motor driver IC 43 drives the DC motor 34.

The motor driver IC can generally drive a plurality of motors. The ink jet printer 1 includes actuators such as a PF motor, a CR motor and the DC motor 34, and furthermore, a release motor, an APG (Auto Paper Gap) motor, an ASF (Auto Sheet Feeder) motor, a pump motor, a pressurizing motor and a plunger, for example.

The release motor is an actuator for separating the PF roller 13 from the follower roller 16 when a board paper is stuck. The APG motor is an actuator for regulating an interval between the recording head 23 and the platen 14. The ASF motor is an actuator for driving the LD roller 11 separately from the PF roller 13. The pump motor is an actuator for ink cleaning. The pressurizing motor is an actuator for pressurizing the ink tank 25.

In the case in which the actuators are provided, the ink jet printer 1 uses a plurality of motor drivers ICs. In this case, it is preferable that the motor driver IC 43 for driving the DC motor 34 should drive the PF motor or the APG motor as another share. By causing the motor drivers IC 43 to share the actuators in such a combination, it is possible to distribute and average a driving timing and a current value between the motor derivers IC 43.

The EEPROM 45 is a memory for storing and holding written data. The EEPROM 45 can write the data through the controller 44. In place of the EEPROM 45, it is also possible to use an RAM (Random Access Memory) having a battery backup function. More specifically, the EEPROM 45 stores a current position 51, an initial high duty value 52, an initial low duty value 53, an initial inter-end driving time 54, a measured inter-end driving time 55, a neutral position setting time 56, an end position setting time 57, and an error deciding time 58.

The current position 51 stored in the EEPROM 45 is information indicative of the newest position of the cylinder 27*b* (the rotator 33). The position of the cylinder 27*b* (the rotator 33) has the mat end position, the neutral position and the photo end position as shown in FIG. 4.

The initial high duty value 52 and the initial low duty value 53 are used for driving the DC motor 34. The initial high duty value 52 and the initial low duty value 53 are prestored in the EEPROM 45. The initial high duty value 52 and the initial low duty value 53 are not updated by a print control. The initial high duty value 52 is used in a rotating and driving operation from the mat end position or the photo end position to the neutral range, for example, and has a high torque at which the push arms 31 and 32 can get over a corner of an almost D shape of the rotator 33. On the other hand, the initial low duty value 53 is used in the rotating and driving operation to the mat end position within the mat range, for example, and has a necessary and sufficient low torque for a movement of the push arms 31 and 32 to slide over a circular outer peripheral portion of the rotator 33, for example.

The initial inter-end driving time 54 is almost equal to a time required for driving the rotator 33 from the mat end position to the photo end position through a predetermined control sequence using the initial high duty value 52 and the initial low duty value 53. The initial inter-end driving time 54 is not updated by a print control.

The measured inter-end driving time 55 is measured when the rotator 33 is driven from the mat end position to the photo end position through a predetermined control sequence using a high control duty value and a low control duty value. The measured inter-end driving time 55 is divided by the initial inter-end driving time 54 so that a weighting coefficient for obtaining a control duty value corresponding to an operating situation of the inkjet printer 1 is obtained. In the beginning, a time which is equal to the initial inter-end driving time 54 is stored in the measured inter-end driving time 55. At this time, a value of the weighting coefficient is one.

The neutral position setting time 56 is required for rotating the rotator 33 to the neutral position within the neutral range by the control duty value based on the initial low duty value 53. While the neutral position setting time 56 is set separately in case of a rotation from the photo range side to the neutral position and in case of a rotation from the mat range side to the neutral position, their mean value is shown in the embodiment. Moreover, it is also possible to take a value obtained from one of them.

The end position setting time 57 is required for rotating the rotator 33 to the mat end position within the mat range by the control duty value based on the initial low duty value 53 or rotating the rotator 33 to the photo end position within the photo range by the control duty value based on the initial low duty value 53. While the end position setting time 57 may be set separately in case of a rotation to the mat end position and in case of a rotation to the photo end position, their mean value is shown in the embodiment. Moreover, it is also possible to take a value obtained from one of them.

The error deciding time 58 is an upper limit time of a driving time when the rotator 33 is rotated from the mat range to the neutral range, from the neutral range to the photo range, from the photo range to the neutral range, or from the neutral range to the mat range by the control duty value based on the initial high duty value 52. The error deciding time 58 may be set separately in case of the rotation from the mat range to the neutral range, in case of the rotation from the neutral range to the photo range, in case of the rotation from the photo range to the neutral range and in case of the rotation from the neutral range to the mat range.

The controller 44 serves to control printing to be carried out by the inkjet printer 1. The controller 44 executes a predetermined initialization processing when the power switch 47 is turned ON. When print data are supplied to the ink jet printer 1, the controller 44 uses the data, which is stored in the EEPROM 45, and the timer 46, thereby executing a print control based on the print data.

It is preferable that the controller 44 should be implemented by causing a CPU (Central Processing Unit) connected to a memory IC (not shown) through a system bus to execute a print control program, for example. The memory and the CPU may be included in one chip. Furthermore, it is also possible to employ a structure in which an ASIC (Application Specific Integrated Circuit) for inputting the MSC signal and the PSC signal is combined in addition to the IC.

Moreover, the print control program may be executed by causing the ink jet printer 1 to read data recorded in a recording medium such as a CD-ROM or may be executed by causing the ink jet printer 1 to download data through a communicating medium such as internet.

Next, description will be given to an operation of the ink jet printer 1 based on the structure.

The controller 44 of the ink jet printer 1 starts an initialization processing when the power switch 47 (not shown) in the printer 1 is turned ON. In the initialization processing, the controller 44 starts a correcting control for the position of the ink selector 27.

Figure 5:
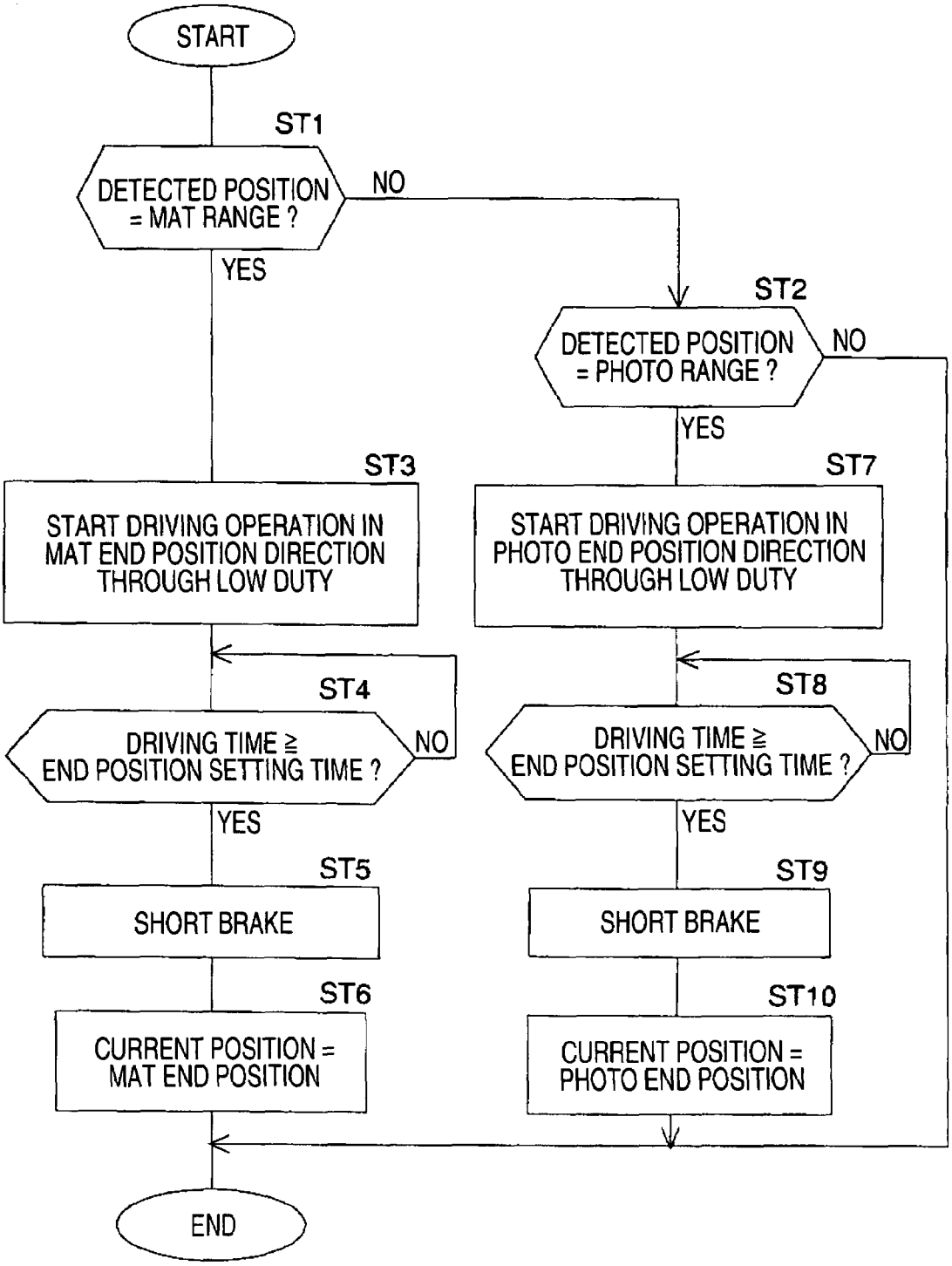
FIG. 5 is a flowchart showing a position correcting sequence at starting.

FIG. 5 is a flowchart showing a position correcting sequence at starting which is to be executed in the initialization processing by the controller 44 in FIG. 3.

In the position correcting sequence at starting, the controller 44 first confirms any position in FIG. 4 in which a current position of the cylinder 27*b* (the rotator 33) is set. More specifically, the controller 44 first reads an MSC signal sent from the two-contact lever detecting switch 42 and decides whether the MSC signal has a high level or not (Step ST1). If the MSC signal has the high level, the controller 44 decides that the current position of the cylinder 27*b* (the rotator 33) is set within the mat range.

If the current position of the cylinder 27*b* (the rotator 33) is not set within the mat range, the controller 44 reads a PSC signal sent from the two-contact lever detecting switch 42 and decides whether the PSC signal has the high level or not (step ST2). If the PSC signal has the high level, the controller 44 decides that the current position of the cylinder 27*b* (the rotator 33) is set within the photo range. If the PSC signal has a low level, the controller 44 ends the position correcting sequence at starting.

If it is decided that the current position of the cylinder 27*b* (the rotator 33) is set within the mat range at the Step ST1, the controller 44 starts a control for setting the position of the cylinder 27*b* (the rotator 33) to be the mat end position.

The controller 44 reads the initial low duty value 53, the measured inter-end driving time 55 and the initial inter-end driving time 54 from the EEPROM 45, and calculates a control duty value based on the following Equation 1. Immediately after the ink jet printer 1 is shipped, the measured inter-end driving time 55 is equal to the initial inter-end driving time 54. For this reason, the initial low duty value 53 is exactly the control duty value. Moreover, "the measured inter-end driving time 55÷the initial inter-end driving time 54" represents a weighting coefficient. When a load to be applied to the DC motor 34 is increased, the measured inter-end driving time 55 is prolonged. The control duty value is also increased correspondingly. To the contrary, when the load to be applied to the DC motor 34 is decreased, the measured inter-end driving time 55 is reduced. The control duty value is also decreased correspondingly.

The control duty value=(the measured inter-end driving time 55÷the initial inter-end driving time 54)×the initial low duty value 53 Equation 1

After calculating the control duty value based on the initial low duty value 53, the controller 44 gives an instruction for a driving start to the motor driver IC 43 (step ST3). The motor driver IC 43 drives the DC motor 34 toward the mat end position based on the control duty value calculated by the controller 44.

After giving the instruction for a driving start to the motor driver IC 43, the controller 44 decides whether a driving time measured by the timer 46 is equal to or greater than the end position setting time 57 stored in the EEPROM 45 (Step ST4). The controller 44 repetitively carries out the decision after the driving operation of the DC motor 34 is started.

When the driving time is equal to or greater than the end position setting time 57, the controller 44 gives an instruction for a short brake to the motor driver IC 43 (Step ST5). The motor driver IC 43 stops the rotation of the DC motor 34

By the control, the position of the cylinder 27*b* (the rotator 33) is set to be the mat end position. The controller 44 updates the current position 51 stored in the EEPROM 45 into the mat end position (Step ST6).

If it is decided that the current position 51 of the cylinder 27*b* (the rotator 33) is set within the photo range at the Step ST2, moreover, the controller 44 starts a control for setting the position of the cylinder 27*b* (the rotator 33) into the photo end position.

The controller 44 reads the initial low duty value 53, the measured inter-end driving time 55 and the initial inter-end driving time 54 from the EEPROM 45, and calculates a control duty value based on the Equation 1. After calculating the control duty value based on the initial low duty value 53, the controller 44 gives an instruction for a driving start to the motor driver IC 43 (Step ST7). The motor driver IC 43 drives the DC motor 34 toward the photo end position based on the control duty value calculated by the controller 44.

After giving the instruction for a driving start to the motor driver IC 43, the controller 44 repetitively decides whether the driving time measured by the timer 46 is equal to or greater than the end position setting time 57 stored in the EEPROM 45 (Step ST8). When the driving time is equal to or greater than the end position setting time 57, the controller 44 gives an instruction for a short brake to the motor driver IC 43 (Step ST9). The motor driver IC 43 stops the rotation of the DC motor 34.

By the control, the position of the cylinder 27*b* (the rotator 33) is set to be the photo end position. The controller 44 updates the current position 51 stored in the EEPROM 45 into the photo end position (Step ST10).

When the initialization processing based on the ON operation of the power is completed, the controller 44 is brought into a print data input standby state. Print data are supplied to the ink jet printer 1 from a personal computer or a digital still camera which is not shown, for example. When the print data are supplied, the controller 44 starts a print processing.

In the print control, the controller 44 first selects an ink to be used for the print. The controller 44 analyzes the print data and decides whether the ink to be used for the print includes a photo black ink or a mat black ink. In the case in which the print medium P is a glossy paper or a photo dedicated paper, for example, the controller 44 decides that the photo black ink is used. As a result, the controller 44 sets a target position of the cylinder 27*b* (the rotator 33) to be the photo end position. In the case in which the print medium P is a mat paper, for example, the controller 44 decides that the mat black ink is used. As a result, the controller 44 sets the target position of the cylinder 27*b* (the rotator 33) to be the mat end position. The controller 44 starts an ink setting control sequence.

Figure 6:
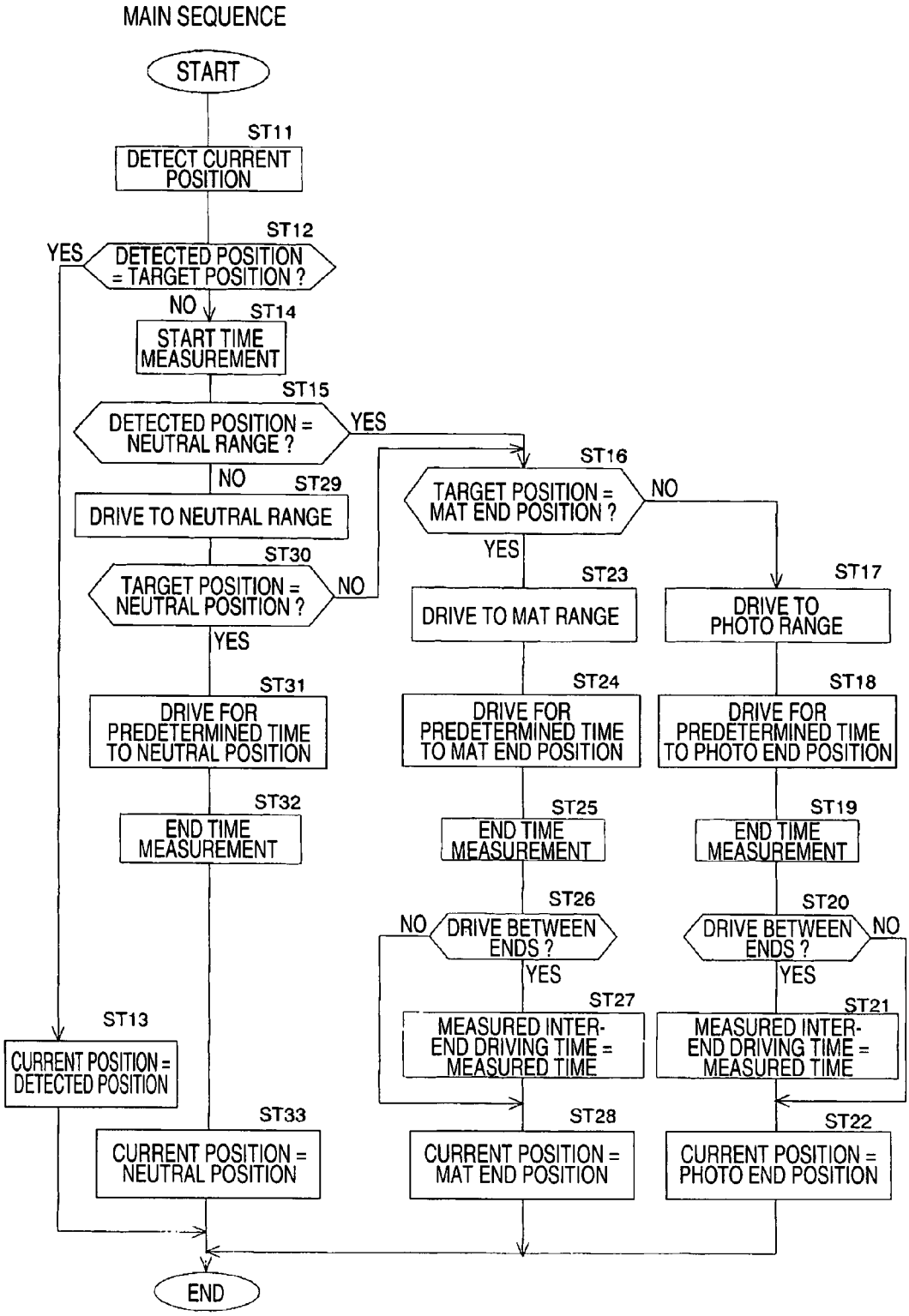
FIG. 6 is a flowchart showing an ink setting control sequence.

FIG. 6 is a flowchart showing the ink setting control sequence to be executed by the controller 44 in FIG. 3. In the ink setting control sequence, the controller 44 first detects a current position of the cylinder 27*b* (the rotator 33) (Step ST11).

Figure 7:
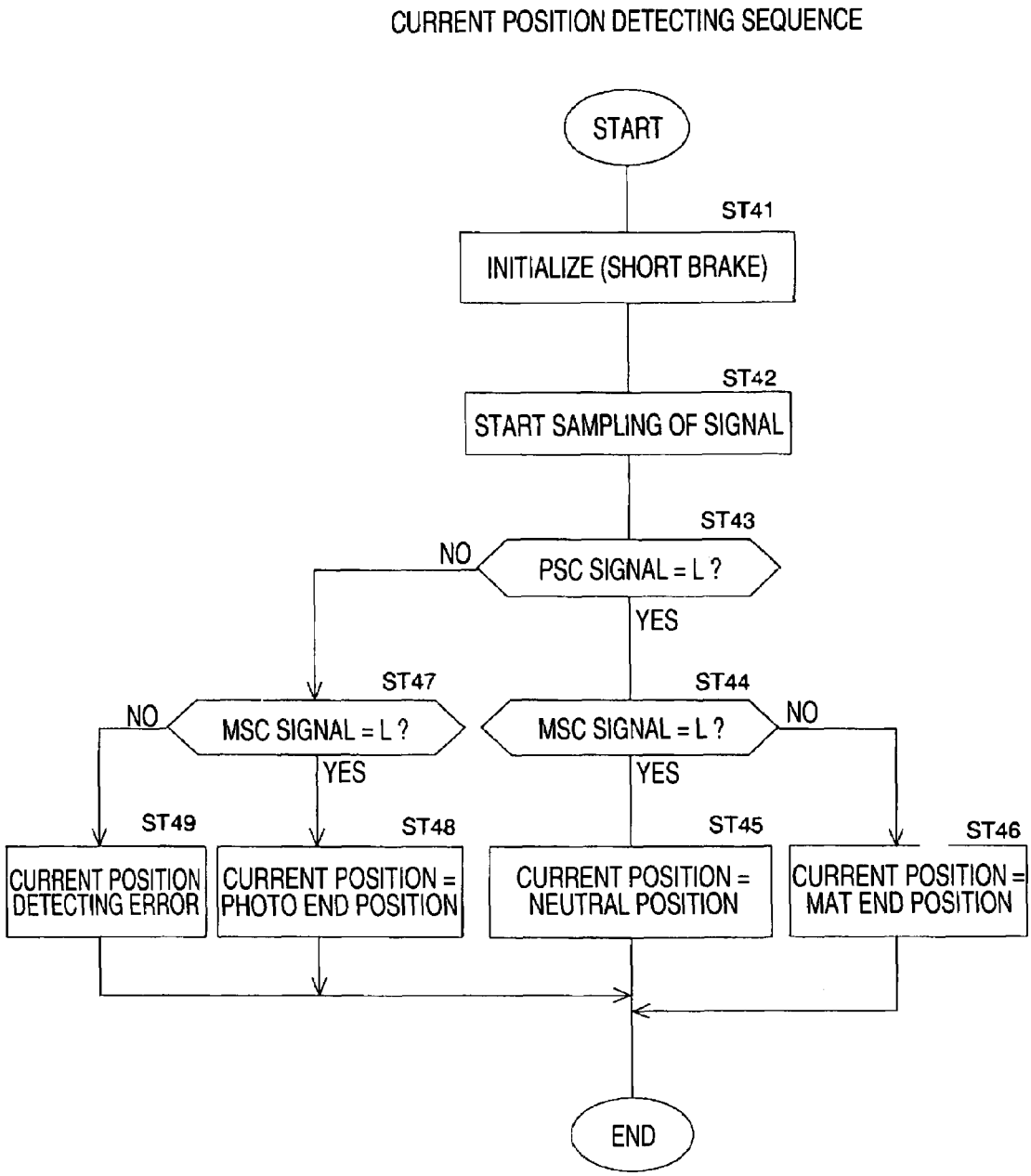
FIG. 7 is a flowchart showing a current position detecting step.

FIG. 7 is a flowchart showing a detailed processing of the current position detecting step (Step ST11) in FIG. 6. At the current position detecting step (Step ST11), the controller 44 first gives an instruction for a short brake to the motor driver IC 43 (Step ST41). The motor driver IC 43 stops the DC motor 34 through the short brake.

After giving the instruction for the short brake processing, the controller 44 starts sampling of the PSC signal and the MSC signal which are sent from the two-contact lever detecting switch 42 (Step ST42). The controller 44 periodically carries out the sampling over the PSC signal and the MSC signal.

After starting the sampling for the PSC signal and the MSC signal which are subjected to the sampling, the controller 44 decides the current position of the cylinder 27*b* (the rotator 33). More specifically, the controller 44 first decides whether the PSC signal has a low level or not (Step S43). If the PSC signal has the low level, the controller 44 further decides whether the MSC signal has the low level or not (Step ST44). If the MSC signal has the low level, the controller 44 decides that the current position of the cylinder 27*b* (the rotator 33) is set within the neutral range and updates the current position 51 of the EEPROM 45 into the neutral position (Step ST45), and the current position detecting step is ended.

If only the MSC signal has the high level, the controller 44 decides that the MSC signal does not have the low level in the decision at the Step ST44 when the PSC signal has the low level. The controller 44 decides that the current position of the cylinder 27*b* (the rotator 33) is set within the mat range. The position of the cylinder 27*b* (the rotator 33) is corrected into the mat end position through the position correcting sequence at starting. The controller 44 updates the current position 51 of the EEPROM 45 into the mat end position (Step ST46) and the current position detecting step is thus ended.

If it is decided that the PSC signal does not have the low level in the decision at the Step 543, that is, it is decided that the PSC signal has the high level, the controller 44 further decides whether the MSC signal has the low level or not (Step ST47). If the PSC signal does not have the low level and the MSC signal has the low level, the controller 44 decides that the current position 51 of the cylinder 27*b* (the rotator 33) is set within the photo range. The position of the cylinder 27*b* (the rotator 33) is corrected into the photo end position through the position correcting sequence at starting. The controller 44 updates the current position 51 of the EEPROM 45 into the photo end position (Step ST48) and the current position detecting step is thus ended.

If both the MSC signal and the PSC signal have the high level, the controller 44 decides that a current position detecting error is made. As shown in FIG. 4, in the ink jet printer 1 which is operated normally, the MSC signal and the PSC signal do not have the high level at the same time. When deciding that the current position detecting error is made, the controller 44 interrupts the control based on the print data and executes a predetermined error processing (Step ST49).

When the current position detecting step ST11 in FIG. 7 is completed, the controller 44 decides whether the detected position of the cylinder 27*b* (the rotator 33) and a target position are coincident with each other or not as shown in FIG. 6 (Step ST12). If the detected position and the target position based on the print data are coincident with each other, the controller 44 updates the current position 51 stored in the EEPROM 45 into the detected position (Step ST13) and the ink setting control sequence in FIG. 6 is thus ended.

On the other hand, if the detected position of the cylinder 27*b* (the rotator 33) and the target position are not coincident with each other, the controller 44 starts a processing of correcting the position of the cylinder 27*b* (the rotator 33).

For example, if the detected position of the cylinder 27*b* (the rotator 33) is set within the neutral range and the target position is the photo end position, the controller 44 decides that the detected position of the cylinder 27*b* (the rotator 33) and the target position are not coincident with each other. The controller 44 starts a correction processing of correcting the position of the cylinder 27*b* (the rotator 33) into the photo end position.

In the correction processing for correcting the position of the cylinder 27*b* (the rotator 33) from the neutral range to the photo end position, the controller 44 first gives the timer 46 an instruction for starting a measurement of a time (Step ST14). Then, the controller 44 decides whether the detected position of the cylinder 27*b* (the rotator 33) is set within the neutral range or not (Step ST15).

If the detected position of the cylinder 27*b* (the rotator 33) is set within the neutral range, the controller 44 decides whether the target position is the mat end position or not (Step ST16). In this case, the target position is the photo end position. The controller 44 decides that the target position is not the mat end position. After deciding that the target position is not the mat end position, the controller 44 first executes a driving control from the neutral range to the photo range (Step ST17).

Figure 8:
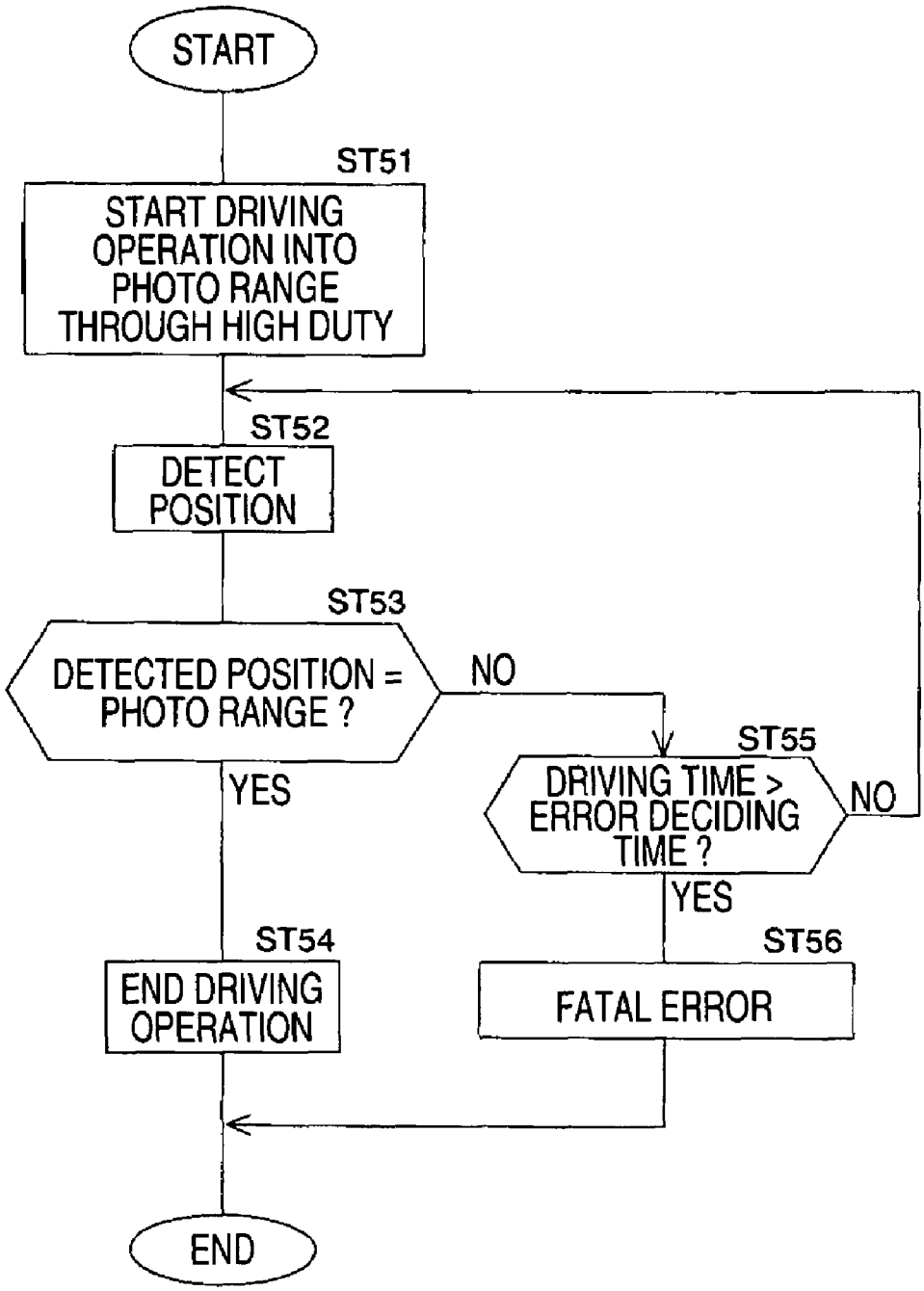
FIG. 8 is a flowchart showing a drive processing till a photo range.

FIG. 8 is a flowchart showing a detailed flow of the drive processing (Step ST17) from the neutral range to the photo range through the controller 44 in FIG. 3. In the drive processing from the neutral range to the photo range, the controller 44 first reads the initial high duty value 52, the measured inter-end driving time 55 and the initial inter-end driving time 54 from the EEPROM 45 and calculates a control duty value based on the Equation 1. The controller 44 gives the motor driver IC 43 an instruction for starting the driving operation of the DC motor 34 to be moved toward to the photo end position (Step ST51). The motor driver IC 43 drives the DC motor 34 based on the control duty value calculated by the controller 44. The rotator 33 is rotated from the neutral range toward the photo end position. The position of the cylinder 27*b* is also moved from the neutral position toward the photo end position.

After giving the motor driver IC 43 the instruction for starting the driving operation, the controller 44 detects the newest position of the cylinder 27*b* (the rotator 33) (Step ST52). Then, the controller 44 decides whether the newest detected position is set within the photo range or not (Step ST53). When the PSC signal is changed from the low level to the high level, the controller 44 decides that the newest detected position is set within the photo range and gives the motor driver IC 43 an instruction for ending the driving operation (Step ST54). The motor driver IC 43 stops the DC motor 34. When the PSC signal is changed from the low level to the high level, the push arm 32 abuts on the notch portion of the rotator 33 as shown in FIG. 4.

If the newest detected position is not set within the photo range, the controller 44 further decides whether the driving time measured by the timer 46 exceeds the error deciding time 58 stored in the EEPROM 45 or not (Step ST55). If the driving time does not exceed the error deciding time 58, the controller 44 repetitively executes the detection of the newest position of the cylinder 27*b* (the rotator 33) (Step ST52), the decision whether the newest detected position is set within the photo range or not (Step ST53) and the decision whether the driving time exceeds the error deciding time 58 or not (Step ST55).

If the driving time exceeds the error deciding time 58, moreover, the controller 44 decides that a fatal error is made and interrupts the driving control to the photo range, and executes a predetermined error processing (Step ST56).

When the driving control from the neutral range to the photo range is completed, the processing returns to FIG. 6 and the controller 44 executes the driving control to the photo end position (Step ST18).

Figure 9:
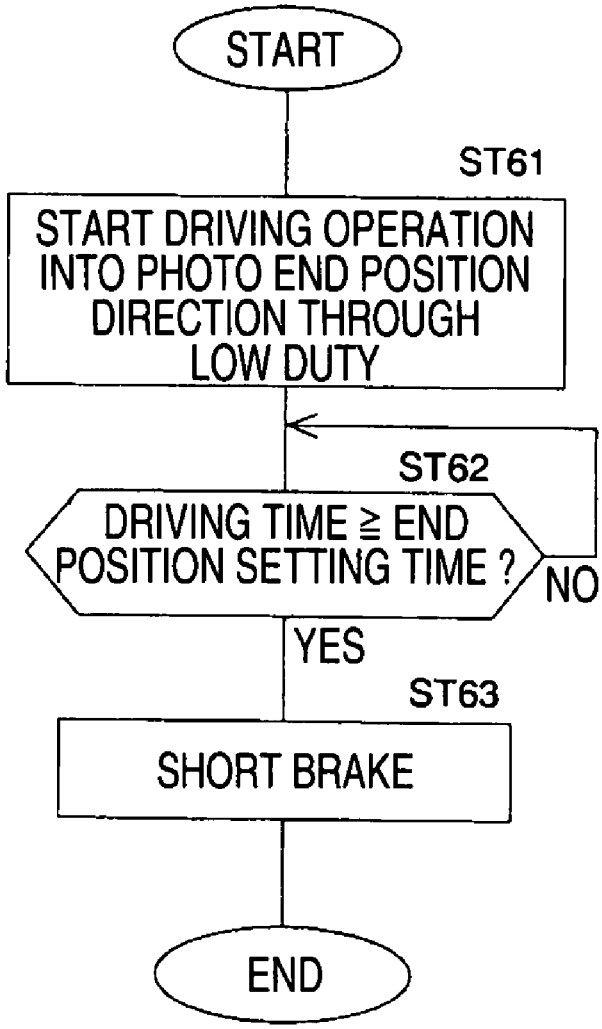
FIG. 9 is a flowchart showing a drive processing till a photo end position.

FIG. 9 is a flowchart showing a detailed flow of the drive processing (Step ST18) to the photo end position through the controller 44 in FIG. 3. In the drive processing to the photo end position, the controller 44 first reads the initial low duty value 53, the measured inter-end driving time 55 and the initial inter-end driving time 54 from the EEPROM 45 and calculates a control duty value based on the Equation 1. The controller 44 gives the motor driver IC 43 an instruction for starting the driving operation of the DC motor 34 to be moved toward the photo end position (Step ST61). The motor driver IC 43 drives the DC motor 34 based on the control duty value calculated by the controller 44. The rotator 33 is rotated toward the photo end position. The position of the cylinder 27*b* is also moved toward the photo end position.

After giving the motor driver IC 43 the instruction for starting the driving operation, the controller 44 decides whether the driving time after the start of the driving control into the photo end position which is measured by the timer 46 is equal to or greater than the end position setting time 57 stored in the EEPROM 45 or not (Step ST62). The controller 44 repetitively makes the decision. When the driving time is equal to or greater than the end position setting time 57, the controller 44 gives the motor driver IC 43 an instruction for a short brake (Step ST63). The motor driver IC 43 stops the DC motor 34 through the short brake. The end position setting time 57 is a time required for rotating the rotator 33 to the photo end position within the photo range in accordance with the control duty value based on the initial low duty value 53.

Consequently, the cylinder 27*b* and the rotator 33 are set into the photo end position. As a result, the push arm 32 in FIG. 4 takes such a posture as to be inserted into the inner part of the selector housing 27 from the right side of the selector housing 27*a* and pushes the cylinder 27*b* in a leftward direction of FIG. 4. Through the slot 27*c* of the cylinder 27*b*, the photo black tube 26*a* communicates with the supply tube 26*c*. It is possible to bring a state in which the photo black ink can be supplied to the recording head 23.

In the driving control into the photo end position within the photo range, the DC motor 34 is driven in accordance with the control duty value based on the initial low duty value 53. Even if the cylinder 27*b* and the rotator 33 reach the photo end position and the driving operation of the DC motor 34 is then maintained continuously, accordingly, the engagement of the gear is not generated in the gear unit 35 between the DC motor 34 and the rotator 33.

When the driving control into the photo end position (Step ST18) is completed, the processing returns to FIG. 6 and the controller 44 ends the measurement of the driving time by the timer 46 (Step ST19). Thereafter, the controller 44 decides whether a current correcting control of the position of the cylinder 27*b* (the rotator 33) is carried out between the photo end position and the mat end position or not (Step ST20). The previous control is carried out from the neutral position to the photo end position. The controller 44 decides that the current correcting control is not carried out between the ends. The controller 44 only updates the current position 51 stored in the EEPROM 45 into the photo end position (Step ST22). The controller 44 ends the correction processing for correcting the current position of the cylinder 27*b* (the rotator 33) into the photo end position.

In addition, in the case in which the detected position of the cylinder 27*b* (the rotator 33) is set within the neutral range and the target position is the mat end position, for example, the controller 44 decides that the detected position of the cylinder 27*b* (the rotator 33) is not coincident with the target position at the Step ST12 and starts a correction processing for correcting the position of the cylinder 27*b* (the rotator 33) into the mat end position.

In the correction processing for correcting the position of the cylinder 27*b* (the rotator 33) into the neutral position to the mat end position, the controller 44 first gives the timer 46 an instruction for starting a measurement of a time (Step ST14). Subsequently, the controller 44 decides that the detected position of the cylinder 27*b* (the rotator 33) is set within the neutral range (Step ST15), and furthermore, decides that the target position is set within the mat end position (Step ST16). The controller 44 executes a driving control to the mat range (Step ST23).

A driving control from the neutral range to the mat range through the controller 44 (Step ST23) is executed in almost the same flow as a drive processing from the neutral range to the photo range by the controller 44 in FIG. 8 (Steps ST51 to 56 which correspond to the Step ST17). More specifically, the controller 44 substitutes the initial high duty value 52, the measured inter-end driving time 55 and the initial inter-end driving time 54 which are stored in the EEPROM 45 for the Equation 1 and thus calculates a control duty value, and gives the motor driver IC 43 an instruction for starting the driving operation of the DC motor 34 to be moved toward the mat end position. Then, the controller 44 repetitively detects the newest position of the cylinder 27*b* (the rotator 33), and gives the motor driver IC 43 an instruction for ending the driving operation when the MSC signal is changed from the low level to the high level. Consequently, the push arm 31 in FIG. 4 abuts on the notch portion of the rotator 33.

When the driving control into the mat range (Step ST23) is completed, the controller 44 executes the driving control into the mat end position (Step ST24). The driving control to the mat end position through the controller 44 (Step ST24) is executed in almost the same flow as the drive processing to the photo end position through the controller 44 in FIG. 9 (Steps ST61 to 63 which correspond to the Step ST18). More specifically, the controller 44 substitutes the initial low duty value 53, the measured inter-end driving time 55 and the initial inter-end driving time 54 which are stored in the EEPROM 45 for the Equation 1 and thus calculates a control duty value, and gives the motor driver IC 43 an instruction for starting the driving operation of the DC motor 34 to be moved toward the mat end position. Then, the controller 44 gives the motor driver IC 43 an instruction for a short brake to stop the DC motor 34 when a driving time required after the start of the driving control into the mat end position measured by the timer 46 is equal to or greater than the end position setting time 57 stored in the EEPROM 45.

By the serial control, the cylinder 27*b* and the rotator 33 are set into the mat end position. As a result, the push arm 31 in FIG. 4 takes such a posture as to be inserted into the inner part of the sector housing 27*a* from the left side of the selector housing 27*a* and pushes the cylinder 27*b* in a rightward direction of FIG. 4. Through the slot 27*c* of the cylinder 27*b*, only the mat black tube 26*b* communicates with the supply tube 26*c*. It is possible to bring a state in which the mat black ink can be supplied to the recording head 23.

Thereafter, the controller 44 ends the measurement of the driving time through the timer 46 (Step ST25) and decides that this correcting control is not carried out between the ends (Step ST26), and updates the current position 51 stored in the EEPROM 45 into the mat end position (Step ST28). The controller 44 ends the correction processing for correcting the position of the cylinder 27*b* (the rotator 33) into the mat end position.

In addition, in the case in which the detected position of the cylinder 27*b* (the rotator 33) is set within the photo range and the target position is the mat end position, for example, the controller 44 decides that the detected position of the cylinder 27*b* (the rotator 33) is not coincident with the target position in the decision at the Step ST12 and starts a correction processing for correcting the position of the cylinder 27*b* (the rotator 33) into the mat end position.

In the correction processing for correcting the position of the cylinder 27*b* (the rotator 33) from the photo range to the mat end position, the controller 44 first gives the timer 46 an instruction for starting the measurement of the time (Step ST14). Subsequently, the controller 44 decides that the detected position of the cylinder 27*b* (the rotator 33) is not set within the neutral range (Step ST15), and first executes a driving control from the photo range to the neutral range (Step ST29).

A driving control from the photo range to the neutral range through the controller 44 (Step ST29) is executed in almost the same flow as a drive processing from the neutral range to the photo range through the controller 44 in FIG. 8 (Step ST17). More specifically, the controller 44 substitutes the initial high duty value 52, the measured inter-end driving time 55 and the initial inter-end driving time 54 which are stored in the EEPROM 45 for the Equation 1 and thus calculates a control duty value, and gives the motor driver IC 43 an instruction for starting the driving operation of the DC motor 34 to be moved toward the neutral position. Then, the controller 44 repetitively detects the newest position of the cylinder 27*b* (the rotator 33), and gives the motor driver IC 43 an instruction for ending the driving operation when the PSC signal is changed from the high level to the low level. Consequently, the pair of push arms 31 and 32 abut on the outer peripheral portion of the rotator 33 in FIG. 4.

When the driving control into the neutral range (Step ST29) is completed, the controller 44 decides whether the target position is the neutral position or not (Step ST30). The target position is the mat end position. The controller 44 decides that the target position is not the neutral position and executes a driving control from the neutral range to the mat range (Step ST23) and a driving control into the mat end position (Step ST24).

By the serial control, the cylinder 27*b* and the rotator 33 are set into the mat end position. As a result, the push arm 31 in FIG. 4 is inserted into the inner part of the selector housing 27*a* from the left side of the selector housing 27*a* and the cylinder 27*b* is pushed in a rightward direction of FIG. 4, and only the mat black tube 26*b* communicates with the supply tube 26*c* through the slot 27*c* of the cylinder 27*b*. It is possible to bring a state in which the mat black ink can be supplied to the recording head 23.

Thereafter, the controller 44 ends the measurement of the driving time through the timer 46 (Step ST25) and decides whether this correcting control is carried out between the ends or not (Step ST26). This driving control is carried out from the photo range into the mat end position. The controller 44 decides that this correcting control is carried out between the ends and updates the measured inter-end driving time 55 stored in the EEPROM 45 with a driving time measured by the timer 46 (Step ST27). Moreover, the controller 44 updates the current position 51 stored in the EEPROM 45 into the mat end position (Step ST28). The controller 44 ends the correction processing for correcting the position of the cylinder 27*b* (the rotator 33) into the mat end position.

In addition, in the case in which the detected position of the cylinder 27*b* (the rotator 33) is set within the mat range and the target position is the photo end position, for example, the controller 44 decides that the detected position of the cylinder 27*b* (the rotator 33) is not coincident with the target position in the decision at the Step ST12 and starts a correction processing for correcting the position of the cylinder 27*b* (the rotator 33) into the photo end position.

The correction processing for correcting the position of the cylinder 27*b* (the rotator 33) from the mat range to the photo end position is executed in almost the same flow as the correction processing for correcting the position of the cylinder 27*b* (the rotator 33) from the photo range to the mat end position. More specifically, the controller 44 first gives the timer 46 an instruction for starting a measurement of a time (Step ST14), and decides that the detected position is not set within the neutral range (Step ST15) and then executes a driving control from the mat range to the neutral range (Step ST29). Thereafter, the controller 44 decides that the target position is neither the neutral position nor the mat end position (Steps ST30 and ST16) and executes a driving control from the neutral range to the photo range (Step ST17) and a driving control to the photo end position (Step ST18).

By the serial control, the cylinder 27*b* and the rotator 33 are set into the photo end position. As a result, the push arm 32 in FIG. 4 is inserted into the inner part of the selector housing 27*a* from the right side of the selector housing 27*a* and the cylinder 27*b* is pushed in the leftward direction of FIG. 4, and only the photo black tube 26*a* communicates with the supply tube 26*c* through the slot 27*c* of the cylinder 27*b*. It is possible to bring a state in which the photo black ink can be supplied to the recording head 23.

Thereafter, the controller 44 ends the measurement of the driving time through the timer 46 (Step ST19) and decides that this correcting control is carried out between the ends (Step ST20) and the measured inter-end driving time 55 stored in the EEPROM 45 is updated into the driving time measured by the timer 46 (Step ST21). Moreover, the controller 44 updates the current position 51 stored in the EEPROM 45 into the photo end position (Step ST22). The controller 44 ends the correction processing for correcting the position of the cylinder 27*b* (the rotator 33) into the photo end position.

By the driving control in the above four patterns, the current position 51 of the cylinder 27*b* (the rotator 33) is set to be coincident with the target position (the mat end position or the photo end position) to be used in the printing operation.

When the selection of the ink to be used in the printing operation and the set control to be carried out in the ink set control sequence in FIG. 6 are completed, the controller 44 starts a paper feeding control and an ink ejecting control based on the print data. The controller 44 first drives the PF motor through the motor driver IC 43 and starts the paper feeding control. By means of the PF motor, the LD roller 11, the PF roller 13 and the paper discharge roller 15 are rotated. The LD roller 11 interposes the print medium P mounted on an uppermost position of the paper feed tray 2 in an outer peripheral portion thereof, and discharges the print medium P from the paper feed tray 2. The print medium P discharged from the paper feed tray 2 in accordance with the rotation of the LD roller 11 passes through the paper guide 12 and is supplied to the PF roller 13. The PF roller 13 and the follower roller 16 interpose and transport the print medium P. Consequently, the print medium P is supplied from a tip portion (leading end) thereof to a print position on the upper side of the platen 14. The controller 44 stops the PF motor in such a timing that the tip portion of the print medium P is supplied to a print position.

When the paper feeding control of the tip portion of the print medium P is completed, the controller 44 drives the CR motor through the motor driver IC 43 and starts an ink ejecting control for a first scan line. The carriage 22 is moved in a main scanning direction, that is, a direction of the carriage shaft 21. Moreover, the controller 44 outputs ink ejection pattern data to the recording head 23 in a print pattern specified by the print data. In the recording head 23, a plurality of piezoelectric elements (not shown) is driven in accordance with the ink ejection pattern data and an ink is ejected. The ink ejected from the recording head 23 is stuck to the tip portion of the print medium P present in a print region. The photo black ink or the mat black ink, which is selected by the ink selector 27, is stuck (ejected) to the print medium P in accordance with the ink ejection pattern data.

When the output of the ink ejection pattern data for the first scan is completed, the controller 44 drives the PF motor through the motor driver IC 43 and starts the paper feeding control. By means of the PF motor, the PF roller 13 and the paper discharge roller 15 are rotated. The print medium P interposed between the PF roller 13 and the driven roller 16 is fed in accordance with the rotation of the PF roller 13. The controller 44 stops the Pr motor when an amount of paper feed reaches a predetermined amount of paper feed based on the print data. In the print region, a new portion of the print medium P is positioned, for example.

When the paper feeding control is completed, the controller 44 starts an ink ejecting control for a second scan line. The controller 44 drives the CR motor, and furthermore, outputs ink ejection pattern data for a second scan to the recording head 23. For example, an ink ejected in accordance with the ink ejection pattern data is stuck to a new portion of the print medium P.

The controller 44 repetitively executes the ink ejecting control and the paper feeding control for each scan line. In the case in which the ink ejection pattern data are not present in a specific scan line, the ink ejection is not carried out but only the paper feed is executed. When the print data are ended or a rear end of the print medium P passes through the print region, the controller 44 ends the ink ejecting control for each scan line. Then, the controller 44 starts the paper discharging control. When the paper discharging control is started, the print medium P is interposed at least between the paper discharge roller 15 and the follower roller 17.

In the paper discharging control, the controller 44 drives the PF motor through the motor driver IC 43. The paper discharge roller 15 is rotated to transport the print medium P interposed together with the follower roller 17 to the paper discharge tray 3 side. The controller 44 drives the PF motor in a time in which the print medium P is supposed to be separated from the paper discharge roller 15. Consequently, the print medium P having the ink stuck thereto is discharged to the paper discharge tray 3.

Moreover, the controller 44 executes a predetermined ink cleaning control based on the number of ON operations of a power supply, a user instruction and a decision for an non-use period. The controller 44 sets the cylinder 27*b* (the rotator 33) into the neutral position, and furthermore, executes the ink cleaning control. The controller 44 executes the ink set control sequence in FIG. 6 in order to set the cylinder 27*b* of the ink selector 27 (substantially, the rotator 33) into the neutral position. At this time, the target position is set to be the neutral position.

By setting the cylinder 27*b* of the ink selector 27 into the neutral position, both the mat black ink and the photo black ink or either of them are/is supplied to the recording head 23 in a probability of a half. Consequently, only one of the mat black ink and the photo black ink can be prevented from being decreased partially due to cleaning.

When the current position 51 of the cylinder 27*b* (the rotator 33) is set within the mat range or the photo range, the controller 44 decides that the current position 51 of the cylinder 27*b* (the rotator 33) is not coincident with the target position (the neutral position) in the decision at the Step ST12. The controller 44 starts the correction processing for correcting the cylinder 27*b* (the rotator 33) into the neutral position.

In the correction processing for correcting the position of the cylinder 27*b* (the rotator 33) from the photo range or the mat range to the neutral position, the controller 44 first gives the timer 46 an instruction for starting a measurement of a time (Step ST14). Then, the controller 44 decides that the detected position of the cylinder 27*b* (the rotator 33) is not set within the neutral range (Step ST15) and first executes a driving control from the photo range or the mat range to the neutral range (Step ST29).

When the driving control to the neutral range (Step ST29) is completed, moreover, the controller 44 decides that the target position is the neutral position (Step ST30) and executes the driving control to the neutral position (Step ST31).

The driving control to the neutral position (Step ST31) is executed in almost the same flow as the drive processing to the photo end position in FIG. 9 (Step ST18). More specifically, the controller 44 substitutes the initial low duty value 53, the measured inter-end driving time 55 and the initial inter-end driving time 54 which are stored in the EEPROM 45 for the Equation 1 and thus calculates a control duty value, and gives the motor driver IC 43 an instruction for starting the driving operation of the DC motor 34 to be moved toward the neutral position. When the driving time of the timer 46 after starting the driving control to the neutral position is equal to or greater than the neutral position setting time 56 stored in the EEPROM 45, then, the controller 44 gives the motor driver IC 43 an instruction for a short brake.

By the serial control, the rotator 33 is set into the neutral position. As a result, the push arm 31 on the upper side and the push arm 32 on the lower side in FIG. 4 are separated from the selector housing 27*a*. At this time, the cylinder 27*b* maintains the mat position state or the photo position state in some cases or might come to the neutral position. In the case in which the cylinder 27*b* is positioned in an almost central part of the cylinder housing 27*a*, the mat black tube 26*b* and the photo black tube 26*a* communicate with the supply tube 26*c* through the slot 27*c* of the cylinder 27*b*. It is possible to bring a state in which the mat black ink and the photo black ink can be supplied to the recording head 23 at the same time.

Thereafter, the controller 44 ends the measurement of the driving time through the timer 46 (Step ST32) and updates the current position 51 stored in the EEPROM 45 into the neutral position (Step ST33). The controller 44 ends the correction processing for correcting the position of the cylinder 27*b* (the rotator 33) into the neutral position. The controller 44 starts an ink cleaning control.

As described above, in the embodiment, the DC Motor 34 drives the ink selector 27 provided on the ink supply path between the recording head 23 and the ink tank 25, and controls the ink selector 27 into the photo end position in which only the photo black ink is supplied to the recording head 23, the mat end position in which only the mat black ink is supplied to the recording head 23, and the neutral position in which the two inks are supplied to the recording head 23 at the same time. The photo end position indicates a position in which the supply of the mat black ink is stopped. Moreover, the mat end position indicates a position in which the supply of the photo black ink is stopped.

Moreover, the two-contact lever detecting switch 42 outputs the PSC signal in which a level is changed between the photo end position and the neutral position and the MSC signal in which the level is changed between the mat end position and the neutral position depending on the position of the lever 42*a* rocked corresponding to the rotating position of the rotator 33.

The controller 44 drives the DC motor 34 by the end position setting time 57 to bring the rotator 33 into the mat end position when the position of the cylinder 27*b* of the ink selector 27 is set into the mat range, drives the DC motor 34 by the end position setting time 57 to bring the rotator 33 into the photo end position when the position of the cylinder 27*b* of the ink selector 27 is set into the photo range, and furthermore, drives the DC motor 34 by the neutral position setting time 56 to bring the rotator 33 to the neutral position when the position of the cylinder 27*b* of the ink selector 27 is set into the neutral range.

As a result, the controller 44 does not directly detect the mat end position, the neutral position and the photo end position but can bring the rotator 33 to their control positions. It is possible to control the rotator 33 to the three control positions while detecting two positions which are less than the three control positions for the ink supply control. By the control of the rotator 33, it is also possible to control the three positions for the cylinder 27*b*.

By detecting the control position of the ink selector 27 by means of only the two-contact lever detecting switch 42, moreover, it is possible to effectively prevent an increase in the size and weight of the carriage 22 along with a reduction in the size and weight of the ink selector 27.

Furthermore, the ink selector 27 is provided in the carriage 22. Therefore, it is possible to minimize the amount of the ink to be thrown away when switching the ink selector 27 to change over the ink to be supplied to the recording head 23.

In the embodiment, moreover, the driving control in a predetermined time of the DC motor 34 after the position of the cylinder 27*b* of the ink selector 27 is set into the mat range, the driving control in a predetermined time of the DC motor 34 after the position of the cylinder 27*b* of the ink selector 27 is set into the photo range, and the driving control in a predetermined time of the DC motor 34 after the position of the cylinder 27*b* of the ink selector 27 is set into the neutral range are executed in accordance with a control duty value based on the initial low duty value 53.

As a result, it is possible to effectively suppress the engagement of the gear in the gear unit 35 irrespective of the fact that the position of the cylinder 27*b* of the ink selector 27 is regulated by the selector housing 27*a* in the mat end position and the photo end position. By carrying out the driving operation to the mat end position or the photo end position at a low torque, moreover, it is possible to set the position of the ink selector 27 into the target mat end position or photo end position accurately and stably.

In the embodiment, moreover, the driving control of the DC motor 34 which is to be carried out before the position of the cylinder 27*b* of the ink selector 27 is set into the mat range, that of the DC motor 34 which is to be carried out before the position of the cylinder 27*b* of the ink selector 27 is set into the photo range, and that of the DC motor 34 which is to be carried out before the position of the cylinder 27*b* of the ink selector 27 is set into the neutral range are executed at a high speed in accordance with a control duty value based on the initial high duty value 52. As a result, a time required for changing over the ink is shortened. Moreover, the rotator 33 can be rotated and driven at such a great torque that the pair of push arms 31 and 32 can get over the outer peripheral portion from the notch portion of the rotator 33.

In the embodiment, furthermore, the controller 44 updates the measured inter-end driving time 55 stored in the EEPROM 45 based on the time measured by the timer 46 in the inter-end driving control. The measured inter-end driving time 55 is divided by the initial inter-end driving time 54 as expressed in the Equation 1, and furthermore, is used as a weighting coefficient in a calculation for the control duty value. When the control duty value is increased with an increase in the measured inter-end driving time 55, and is decreased with a reduction in the measured inter-end driving time 55. The torque of the DC motor 34 is increased/decreased depending on the measured inter-end driving time 55.

As a result, even if the load to be applied to the DC motor 34 is increased/decreased due to a variation or aging, the driving time of the DC motor 34 is always stabilized to be almost constant. The controller 44 can stably set the position of the cylinder 27*b* of the ink selector 27 into the mat end position, the photo end position and the neutral position by a driving operation for a certain time. By increasing/decreasing the torque depending on the load, moreover, it is possible to prevent a small load from being driven at a high speed with a high torque. Thus, it is possible to prevent a driving sound from being increased. In addition, it is possible to prevent the driving operation from being disabled due to an insufficient torque, for example.

In the embodiment, moreover, when the DC motor 34 is driven among the mat range, the neutral range and the photo range, the driving operation is controlled by a division into each range. Therefore, the position of the cylinder 27*b* of the ink selector 27 is stabilized on a range boundary immediately before a target control position irrespective of the range at the start of the driving operation. Furthermore, the position of the cylinder 27*b* is stabilized in a control position to be a final target position. Also in the case in which the control is carried out from a mat region to a photo region, for example, the controller 44 can use control information in a neutral region therebetween in common.

In the embodiment, furthermore, the controller 44 drives the DC motor 34 for a predetermined time in such a manner that the position of the ink selector 27 is set into the mat end position or the photo end position when the power supply is turned ON before the printing operation is started. As a result, when the printing operation is started, the position of the ink selector 27 is coincident with the mat end position or the photo end position which is stored in the EEPROM 45. The position of the ink selector 27 can be prevented from being set to be an unstable position which is different from the detected position. The controller 44 can update the current position 51 in the EEPROM 45 into the mat end position or the photo end position by simply deciding the range of the cylinder 27*b* (the rotator 33) based on the MSC signal and the PSC signal as shown in FIG. 7 when the printing operation is started.

The above embodiment is an example of a preferred embodiment according to the invention. However, the invention is not restricted thereto but various changes and modifications can be made without departing from the scope of the invention.

For example, in the embodiment, the DC motor 34 is driven continuously based on the control duty value in the driving control for correcting the position of the cylinder 27*b* (the rotator 33). In addition, the DC motor 34 may be driven intermittently based on the control duty value, for example. By intermittently carrying out the driving operation with the control duty value, thus, it is possible to expect the effect of further suppressing the engagement of the gear in the gear unit 35 between the DC motor 34 and the rotator 33 when the driving operation to the mat end position or the photo end position is carried out with the control duty value based on the initial low duty value 53, for example.

In the embodiment, the position of the cylinder 27*b* (the rotator 33) is controlled into the three positions including the mat end position, the neutral position and the photo end position. In addition, for example, the position of the cylinder 27*b* (the rotator 33) may be controlled into two positions including the mat end position and the photo end position or at least four positions. Also in case of the variants, it is possible to implement the driving control into each position through a detection of positions in a smaller number of the control positions by using a signal to be changed between two adjacent target positions.

In the embodiment, the cylinder 27*b* includes the slot 27*c* and causes both the mat black tube 26*b* and the photo black tube 26*a* to communicate with the supply tube 26*c* in the neutral position. In addition, for example, the cylinder 27*b* may prevent both the mat black tube 26*b* and the photo black tube 26*a* from communicating with the supply tube 26*c* in the neutral position.

In the embodiment, the controller 44 executes a fatal error processing when the driving time exceeds the error deciding time 58 in the driving control from the neutral range to the photo range (Step ST17), the driving control from the neutral range to the mat range (Step ST23), the driving control from the photo range to the neutral range (Step ST29) and the driving control from the mat range to the neutral range (Step ST29). In addition, for example, the controller 44 increases the control duty value to continuously carry out the driving control if the range for the detected position is not changed over a certain time, and may execute the fatal error processing if the range for the detected position is not changed in a predetermined time such as the error deciding time 58.

In the embodiment, the controller 44 updates the measured inter-end driving time 55 stored in the EEPROM 45 in a driving time required for a control between ends after the control between ends (Steps ST21 and ST27). In addition, for example, the controller 44 may calculate an average of the driving time required for the control between ends and the measured inter-end driving time 55 stored in the EEPROM 45, and may update the measured inter-end driving time 55 stored in the EEPROM 45 based on the average value. By taking the average value, thus, it is possible to suppress a bad influence when a long driving time is irregularly taken. To the contrary, by exactly using the driving time taken for the control between ends as in the embodiment, it is possible to stabilize the driving time following a rapid change in a load of the DC motor 34 sensitively if any.

In the embodiment, the ink selector 27 is controlled into the mat end position in which the mat black ink is supplied, the neutral position and the photo end position in which the photo black ink is supplied. In addition, for example, the ink selector 27 may be controlled between the position in which the mat black ink is supplied and the position in which the supply is stopped.

In the embodiment, the ink selector 27 and the DC motor 34 are provided in the carriage 22. In addition, for example, the ink selector 27 and the DC motor 34 may be provided separately from the carriage 22. To the contrary, the ink tank unit 24 may be provided in the carriage 22.

While the position of the rotator 33 to be the member for driving the ink selector 27 is detected in the embodiment, the position of the ink selector 27 may be detected directly.

The invention can be suitably utilized in an ink jet printer for ejecting an ink onto a print medium such as a paper, thereby carrying out a printing operation.

What is claimed is:

1. An ink supply control apparatus comprising:

a driver, operable to drive a selector provided between a recording head and an ink tank to control an ink supply from the ink tank to the recording head;

a detector, operable to detect that the selector is disposed in a predetermined position between two positions of at least two control positions; and a controller, operable to control the driver so as to stop the selector in one of the two positions in a predetermined time after the detector detects that the selector is disposed in the predetermined position.

2. The ink supply control apparatus according to claim 1, wherein the at least two control positions include a first control position in which the ink supply from the ink tank to the recording head is allowed and a second control position in which the ink supply from the ink tank to the recording head is stopped.

3. The ink supply control apparatus according to claim 1, wherein the ink supply includes a first ink supply for a first ink and a second ink supply for a second ink having different kind from the first ink, and the at least two control positions include a first control position in which the first ink supply from the ink tank to the recording head is allowed and a second control position in which the second ink supply from the ink tank to the recording head is allowed.

4. The ink supply control apparatus according to claim 1, wherein the controller is configured to drive the driver at a first torque after the detector detects that the selector is disposed in the predetermined position and to drive the driver at a second torque before the detector detects that the selector is disposed in the predetermined position, and the first torque is greater than the second torque.

5. The ink supply control apparatus according to claim 1, further comprising a timer, operable to measure a control time of the driver through the controller, the controller is configured to control a torque for driving the driver in accordance with the control time measured by the timer.

6. The ink supply control apparatus according to claim 1, wherein the at least two control positions include at least three control positions, the predetermined position includes a first predetermined position between adjacent two positions of the at least three control positions and a second predetermined position between another adjacent two positions of the at least three control positions, and the controller is configured to drive the driver every section divided by the first and second predetermined positions before the detector detects the selector in one of the first and second predetermined positions which is followed by one of the at least three control positions which is a target.

7. The ink supply control apparatus according to claim 1, wherein the detector includes a lever member movable in accordance with the at least two positions and is configured to output, to the controller, a detection signal corresponding to a position of the lever member.

8. The ink supply control apparatus according to claim 1, wherein the controller is configured to control the driver so as to stop the selector in the one of the two positions before a printing operation is started.

9. An ink jet printer comprising:

the ink supply control apparatus according to claim 1;

a carriage, provided with the recording head and the selector;

a tank unit to which the ink tank is removably attached, provided separately from the carriage; and a tube, connected to the ink tank and the recording head through the selector.

10. An method of controlling an ink supply comprising:

driving a selector provided between a recording head and an ink tank and giving an instruction for starting a driving operation of a driver for controlling the ink supply from the ink tank to the recording head;

detecting that the selector is in a predetermined position between two positions of at least two control positions; and stopping the driving operation of the driver so as to stop the selector in one of the two positions in a predetermined time after detecting that the selector is in the predetermined position.

11. The method according to claim 10, wherein the at least two control positions include a first control position in which the ink supply from the ink tank to the recording head is allowed and a second control position in which the ink supply from the ink tank to the recording head is stopped.

12. The method according to claim 10, wherein the ink supply includes a first ink supply for a first ink and a second ink supply for a second ink having different kind from the first ink, and the at least two control positions include a first control position in which the first ink supply from the ink tank to the recording head is allowed and a second control position in which the second ink supply from the ink tank to the recording head is allowed.

* * * * *